US009931872B2

(12) United States Patent
Wind

(10) Patent No.: US 9,931,872 B2
(45) Date of Patent: Apr. 3, 2018

(54) METHOD AND FLATBED PRINTER FOR CREATING PRINTS ON PIECES OF MEDIA HAVING A DIFFERENT THICKNESS

(71) Applicant: Océ-Technologies B.V., Venlo (NL)

(72) Inventor: Anne A. Wind, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/450,774

(22) Filed: Mar. 6, 2017

(65) Prior Publication Data

US 2017/0173982 A1 Jun. 22, 2017

Related U.S. Application Data

(63) Continuation of application No. PCT/EP2015/071088, filed on Sep. 15, 2015.

(30) Foreign Application Priority Data

Sep. 18, 2014 (EP) ..... 14185300

(51) Int. Cl.
*B41J 3/28* (2006.01)
*B41J 13/00* (2006.01)

(52) U.S. Cl.
CPC ..... *B41J 13/0009* (2013.01)

(58) Field of Classification Search
None
See application file for complete search history.

(56) References Cited

FOREIGN PATENT DOCUMENTS

EP 1 313 619 B1 4/2008
JP 5161402 B1 3/2013

*Primary Examiner* — Alejandro Valencia
(74) *Attorney, Agent, or Firm* — Birch, Stewart, Kolasch & Birch, LLP

(57) ABSTRACT

A method for printing by means of a flatbed printer including a flatbed surface for placing a plurality of pieces of media to be printed upon, the plurality of pieces of media having different thicknesses, a control unit for controlling the printing of digital images on the plurality of pieces of media, a gantry constructed to move over the flatbed surface in a first direction and extending in a second direction, a print head configured to eject recording material on the plurality of pieces of media and attached to the gantry, the method including the steps of dividing the flatbed surface into a plurality of strips extending in the second direction over a length of the flatbed surface in the second direction, storing a position of each of the plurality of strips in storage of the control unit, for each strip coupling in storage a thickness range to the strip, the thickness range including a maximum allowed thickness for a piece of media to be placed in the strip on the flatbed surface and a minimum allowed thickness for a piece of media to be printed upon when placed in the strip on the flatbed surface, establishing a position of each piece of media of the plurality of pieces of media in the appropriate strip according to the thickness of the piece of media, moving the print head over the flatbed surface, and ejecting the recording material on the plurality of pieces of media when moving the print head over the flatbed surface, wherein upon the print head reaching a strip when moving over the flatbed surface, adapting the distance from the print head to the flatbed surface according to the thickness range coupled to the strip.

17 Claims, 15 Drawing Sheets

METHOD AND FLATBED PRINTER FOR CREATING PRINTS ON PIECES OF MEDIA HAVING A DIFFERENT THICKNESS

CROSS REFERENCE TO RELATED APPLICATIONS

This application is a Continuation of PCT International Application No. PCT/EP2015/071088, filed on Sep. 15, 2015, which claims priority under 35 U.S.C. 119(a) to patent application Ser. No. 14/185,300.2, filed in Europe on Sep. 18, 2014, all of which are hereby expressly incorporated by reference into the present application.

FIELD OF THE INVENTION

The present invention relates to a method for printing by means of a flatbed printer comprising a flatbed surface for placing a plurality of pieces of media to be printed upon, the plurality of pieces of media having different thicknesses, a control unit for controlling the printing of digital images on the plurality of pieces of media, a gantry constructed to move over the flatbed surface in a first direction and extending in a second direction, a print head configured to eject recording material on the plurality of pieces of media and attached to the gantry.

The present invention also relates to a flatbed printer configured to execute the method of the present invention.

The present invention further relates to a non-transitory computer program product, including computer readable code embodied on a computer readable medium, said computer readable code comprising instructions for printing on a plurality of pieces of media of different thicknesses by means of a flatbed printer according to the method of the invention.

The print head of the flatbed printer may be mounted on a gantry above the flatbed surface. The gantry may be moving over the flatbed surface in a first direction, while the print head is movable along the gantry in a second direction perpendicular to the first direction. In case of a print head having a same width as the flatbed surface, the print head may be moving in one direction over the flatbed surface, i.e. the first direction. The control unit is connected to the print head for controlling the print head. The control unit is controlling the movement of the print head over the flatbed surface and the ejection of recording material towards the flatbed surface. The distance from the print head to the flatbed surface may be variable in order to allow the printing of pieces of media of different thicknesses.

The recording material may be hot melt ink or a UV curable ink. When the latter ink is used, the print head is also provided with UV lamps for curing the recording material when ejected on the piece of media placed on the flatbed surface. The flatbed surface usually has the form of a rectangle, for example of a width of 1.22 m and a length of 1.22 m, or of a width of 1.22 m and a length of 2.44 m.

A piece of media with dimensions smaller or equal to the dimensions of the flatbed surface can be placed on the flatbed surface. Even a piece of media with dimensions larger than the dimensions of the flatbed surface can be placed on the flatbed surface and has to be moved to get it completely printed.

Flatbed print systems usually apply recording material, like colorants, on a piece of media placed on the flatbed in the form of toner or ink according to a digitally defined, two-dimensional pattern of pixels with values that indicate a composition of these colorants. This pattern is generated out of a digital image, that may comprise objects in either vectorized or rasterized format, using conventional techniques like interpretation, rendering, and screening by a raster image processor. The processing of a digital image includes color management to convert color values of the pixels in the digital image into composition values related to the printer color space as is set up by the colorants of the print system. Depending on the intended print quality and the characteristics of the print process, the pixels of the pattern may be printed in more than one pass, wherein a position of the piece of media on the flatbed has an opportunity to receive a colorant in one or more of the passes of the print head across the flatbed.

BACKGROUND OF THE INVENTION

An operator may place pieces of media on the flatbed surface in order to print images on the pieces according to digital images which have been offered to the control unit. Positioning of a piece of media must be done very accurate with respect to its position and orientation. The operator usually measures right-angled distances of the piece of media from the edges of the flatbed surface by a measuring tool like a measuring cord, a tape-measure or a ruler. Another method to position the media is to align the piece of media with reference rules which have been printed on the flatbed table beforehand. The operator enters the measured distances by means of an application running on a computer connected to the control unit of the flatbed printer or on the control unit itself. After entering the distances, the operator selects the digital image to be printed on the piece of media and start the printing of the flatbed printer. Therefore the control unit or the computer is provided with a user interface suitable for data entry in general. Resuming, the operator has to execute different manual steps. Each step may lead to operator errors before printing the digital image on the piece of media. To make it even more complex pieces of media may be placed on the flatbed table that have different thicknesses. The thickness of a piece media is measured from the flatbed surface in the direction perpendicular to the flatbed surface. The different thicknesses of the pieces of media lying on the flatbed surface of the flatbed printer may lead to dangerous situations, for example the print head may touch one of the pieces of media if it is higher than a piece of media that has just been printed upon and the print head has not yet been lifted to an appropriate height from the flatbed surface in order to print the higher piece of media.

It is an object of the present invention to achieve a method for error free printing of a plurality of media pieces of different thicknesses by means of a flat bed printer.

SUMMARY OF THE INVENTION

According to the present invention this object is achieved by a method comprising the steps of dividing the flatbed surface into a plurality of strips extending in the second direction over a length of the flatbed surface in the second direction, storing a position of each of the plurality of strips in storage of the control unit, for each strip coupling in storage a thickness range to the strip, the thickness range comprising a maximum allowed thickness for a piece of media to be placed in the strip on the flatbed surface and a minimum allowed thickness for a piece of media to be printed upon when placed in the strip on the flatbed surface, establishing a position of each piece of media of the plurality of pieces of media in the appropriate strip according to the thickness of the piece of media, moving the print head over the flatbed surface, and ejecting the recording material on the plurality of pieces of media when moving the print head over the flatbed surface, wherein upon the print head reaching a strip when moving over the flatbed surface, adapting the distance from the print head to the flatbed surface according to the thickness range coupled to the strip. It is preferred that the thickness ranges of adjacent strips are mutual exclusive. The thickness ranges may have a width with is related to a tolerance distance from the print head to the piece of media as specified in print specifications of the flatbed printer. If the flatbed printer is capable to print relief prints, also known as 2.5 D printing, the thickness range also take into account the total height of the plurality of ink layers to be ejected on the piece of media.

According to an embodiment the dividing step comprises the step of detecting marks placed on the flatbed surface, which marks are marking the strips. By doing so, the operator easily recognizes a strip and the allowed thickness range coupled to the strip. The marks for a strip may have a specific color or textual indication related to the allowed thickness range.

According to an embodiment the flatbed printer comprises a projector system connected to the control unit and positioned above the flatbed surface and the dividing step comprises the step of projecting at least one digital image on the flatbed surface, the at least one digital image displaying the plurality of strips. The at least one digital image may be derived beforehand from the stored positions of the plurality of strips in storage of the control unit. The at least one digital image may comprise a textual indication which indicates which thickness ranges of pieces of media are allowed in each strip. The at least one digital image may comprise a color indicating which thickness ranges of pieces of media are allowed in each strip. It is preferred to project the at least one digital image on the flatbed surface before the pieces of media are placed on the flatbed surface. However, the pieces of media may already been placed on the flatbed surface before the at least one digital image is projected on the flatbed surface. In both cases the operator is able to move a piece of media over the flatbed surface in order to get a position of the piece of media in a projected strip of the projected at least one image so that the thickness of the piece of media is in accordance with the thickness prescribed for the projected strip.

According to an embodiment the flatbed printer comprises a registration system for registering a thickness of each piece of media placed on the flatbed surface and the establishing step comprises a step of checking by means of the camera system if the thickness of each piece of media placed in a strip of the plurality of strips is in accordance with the thickness range coupled to the strip. The registration system may comprise at least one camera system directed towards the flatbed surface, and/or at least one captor and/or at least one sensor positioned above the flatbed surface. The at least one camera may be of the type RGB or RGB-D. The registration system is enabled to register each piece of media which is placed on the flatbed surface. A digital image derived from the registering actions of the registration system is processed by an image processing software component stored in the control unit in order to detect the shape, the position and the size of the piece of media on the flatbed. Properties of the piece of media, like width, length, area size and contour may be derived from the detected shape and size. A piece of media placed on the flatbed may have an arbitrary shape and a suitable size with respect to the length and width of an appropriate strip and a thickness prescribed by placing the piece of media in the appropriate strip.

According to an embodiment the method comprises the steps of creating a no-place area on the flatbed surface between two adjacent strips of the plurality of strips, in which no-place area no piece of media is allowed to be placed that has a thickness larger than the minimum of the thickness ranges coupled to the two adjacent strips, and adapting the distance from the print head to the flatbed surface in accordance with the thickness range coupled to one strip of the two adjacent strips while the print head is moving in the no-place area from the other strip of the two adjacent strips to the one strip. Theoretically, the no-place area may have a width of zero or more. In practice, the no-place area has a minimum width derived from the geometry—width, length and height—of the gantry and the print head, in particular the geometry in the second direction. When selecting the minimum width for the no-place area the movement of the print head in the second direction will be stopped and a movement of the print head in a direction perpendicular to the flatbed surface will be started to position the print head at the correct height distance to the flatbed surface.

The present invention also relates to a flatbed printer comprising a flatbed surface for placing a plurality of pieces of media to be printed upon, the plurality of pieces of media having different thicknesses, a control unit for controlling the printing of digital images on the plurality of pieces of media, a gantry constructed to move over the flatbed surface in a first direction and extending in a second direction, a print head configured to eject recording material on the plurality of pieces of media and attached to the gantry, wherein the flatbed surface is divided into a plurality of strips extending in the second direction over a length of the flatbed surface in the second direction, the control unit comprises in storage for each strip of the plurality of strips a position of the strip on the flat bed surface and a thickness range coupled to the strip, the thickness range comprises a maximum allowed thickness for a piece of media to be placed in the strip on the flatbed surface and a minimum allowed thickness for a piece of media to be printed upon when placed in the strip on the flatbed surface, the control unit comprises establishing means for establishing a position of each piece of media of the plurality of pieces of media in the appropriate strip according to the thickness of the piece of media, and the flatbed printer comprises adapting means for adapting the distance from the print head to the flatbed surface, wherein upon the print head reaching a strip when moving over the flatbed surface in order to eject the recording material on the plurality of pieces of media, the adapting means adapt the distance from the print head to the flatbed surface according to the thickness range coupled to the strip.

According to an embodiment the flatbed printer comprises a projector system connected to the control unit and positioned above the flatbed surface for projecting at least one image on the flatbed surface, the at least one image displaying the plurality of strips.

According to a further embodiment of the flatbed printer the at least one image comprises a textual indication which indicates which thicknesses of pieces of media are allowed in each strip. According to an alternative embodiment the at least one image comprises a color which indicates which thicknesses of pieces of media are allowed in each strip.

According to an embodiment the flatbed printer comprises a registering system for registering a thickness of each piece of media placed on the flatbed surface and the control unit is configured to check by means of the registration system if the thickness of each piece of media placed in a strip of the plurality of strips is in accordance with the thickness range coupled to the strip.

According to an embodiment of the flatbed printer the flatbed surface comprises a no-place area on the flatbed surface between two adjacent strips of the plurality of strips, in which no-place area no piece of media is allowed to be placed that has a thickness larger than the minimum of the thickness ranges coupled to the two adjacent strips, and the control unit is configured to adapt the distance from the print head to the flatbed surface by means of the adapting means in accordance with the thickness range coupled to one strip of the two adjacent strips upon moving the print head in the no-go area from the other strip of the two adjacent strips to the one strip.

The present invention also relates to a non-transitory recording medium comprising computer executable program code configured to instruct a computer to perform the method according to the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

Hereinafter the present invention is further elucidated with references to the appended drawings showing non-limiting embodiments and wherein.

DETAILED DESCRIPTION OF EMBODIMENTS

Figure 1:
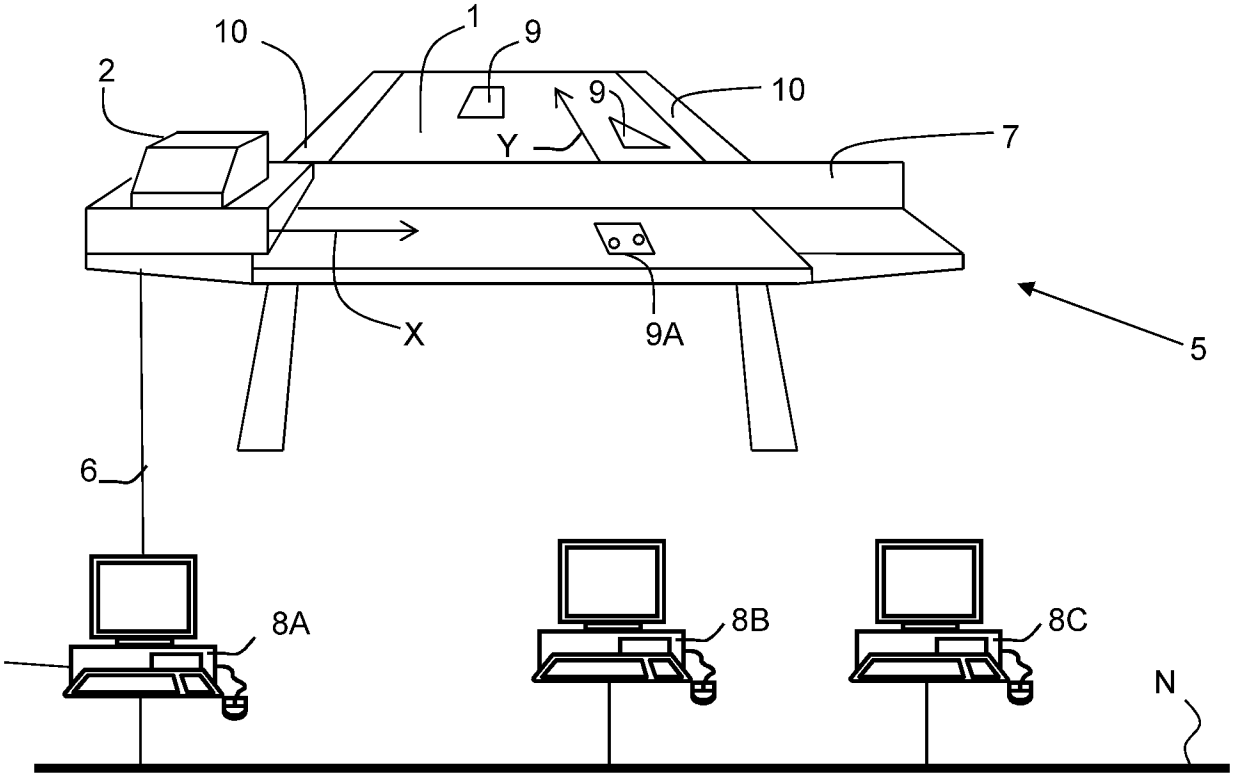
FIG. 1 shows a print system configured to apply the invented method.

FIG. 1 is a print system 5 comprising a number of workstations 8B, 8C, which may be personal computers or other devices for preparing image data for prints to be printed. These workstations have access to a network N for transferring the image data to a print controller 8A that is configured to receive print jobs for prints and derive pass images. The print controller 8A may be part of the print system 5 connected to a control unit of the print system 5 via a connection 6. The print system 5 further comprises a print head 2 for applying colorants, for example cyan (C), magenta (M), yellow (Y), black (K) and white (W) colorant, or varnish to pieces 9, 9A of flat print media placed on a flatbed surface 1 in order to obtain a printed image. The flatbed surface 1 is the surface of the flatbed which is at least partially printable by the print head 2. The pieces of media may be so small that they are completely placed on the flatbed surface 1, but a piece of media which is larger than the flatbed surface, in which case an image which is going to cover the whole piece of media must be printed into a plurality of parts of the image, is not excluded. A first piece 9A has already been printed upon, while the other pieces 9 are not provided with any recording material yet. The print head 2 reciprocally scans the flatbed surface 1 in the second direction X along a gantry 7 perpendicular to a first direction Y of the gantry 7 over the flatbed surface 1 along guiding parts 10. During printing of an image on the piece 9, 9A of media the piece 9, 9A of media is not moved on the flatbed surface 1. This way of working is advantageous for rigid print media. A print head which is as wide as the flatbed surface may also be envisaged within the scope of the invention. Such a print head may be moveable in at least one direction over the flatbed surface 1. The piece of media 9A may have a thickness of 10 mm, while the pieces of media 9 may have a thickness of 20 mm.

Figure 2:
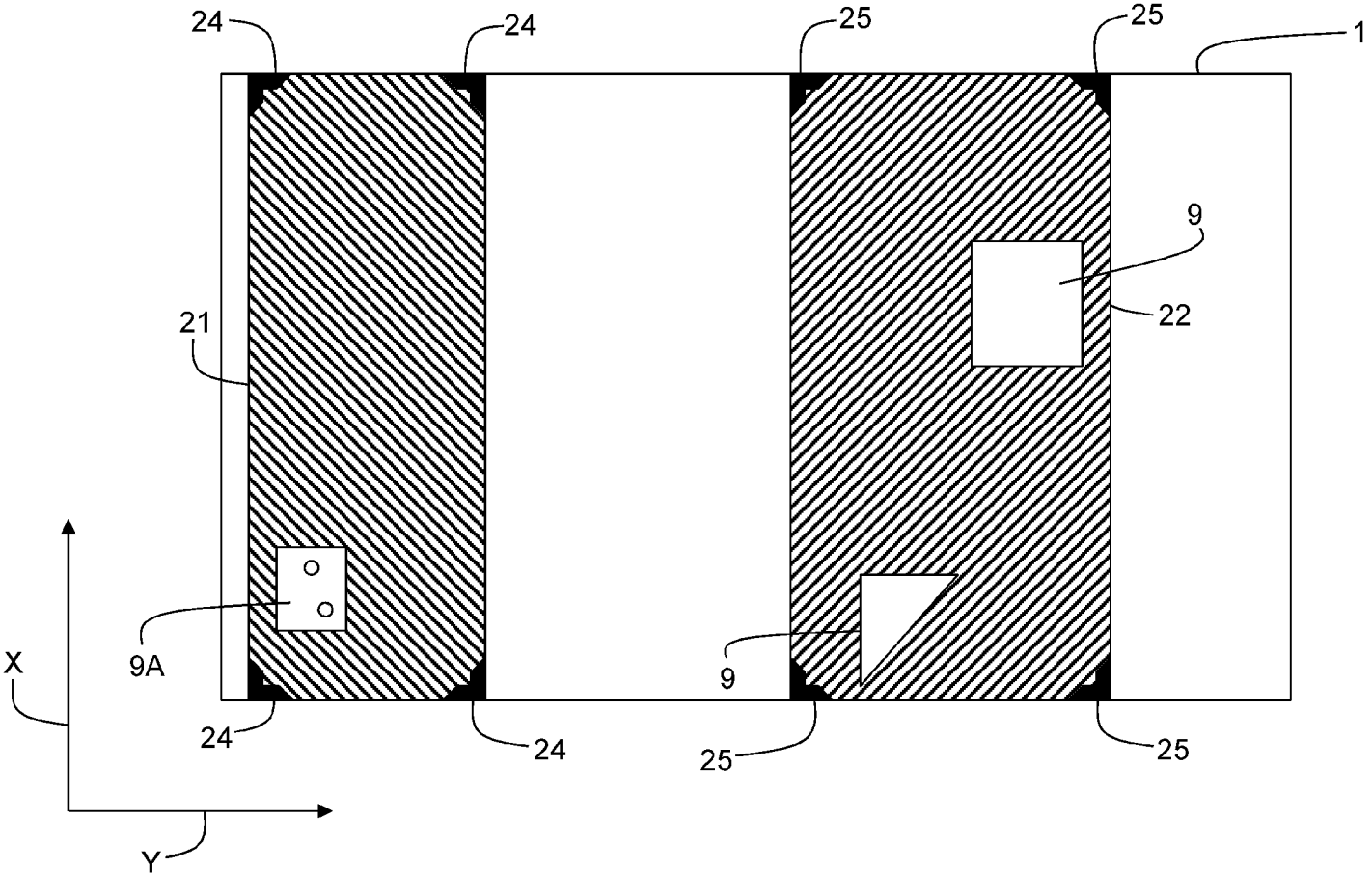
FIG. 2 is a top view of a flatbed surface of the printing system in FIG. 1.

FIG. 2 shows the flat bed surface 1 of FIG. 1 from a different viewpoint. The flatbed surface 1 is divided into a first strip 21 and a second strip 22. A thickness range from 9 mm to 12 mm is coupled to the first strip 21. A thickness range from 19 to 22 mm is coupled to the second strip 22. Piece of media 9A having a thickness of 10 mm is positioned in the first strip 21 which is a correct strip for printing, because 10 mm lies in the thickness range of the first strip 21. Pieces of media 9 having a thickness of 20 mm are positioned in the second strip 22 which is a correct strip for printing, because 20 mm lies in the thickness range of the second strip 22. Green colored markers 24 placed, attached or printed on the flatbed surface 1 indicate the corners of the first strip 21. Blue colored markers 25 placed, attached or printed on the flatbed surface 1 indicate the corners of the second strip 22. Other colors for the markers may be envisioned. For a strip a textual indication of the thickness range coupled to the strip may be shown on the flatbed surface 1, for example in the same color as the corresponding markers. In another embodiment a part of the flatbed surface corresponding to a strip may be painted in an appropriate color distinguishable from a color of another strip. In another embodiment a boundary of an area of the flatbed surface corresponding to a strip may be outlined in an appropriate color distinguishable from a colored boundary of another strip.

Figure 3:
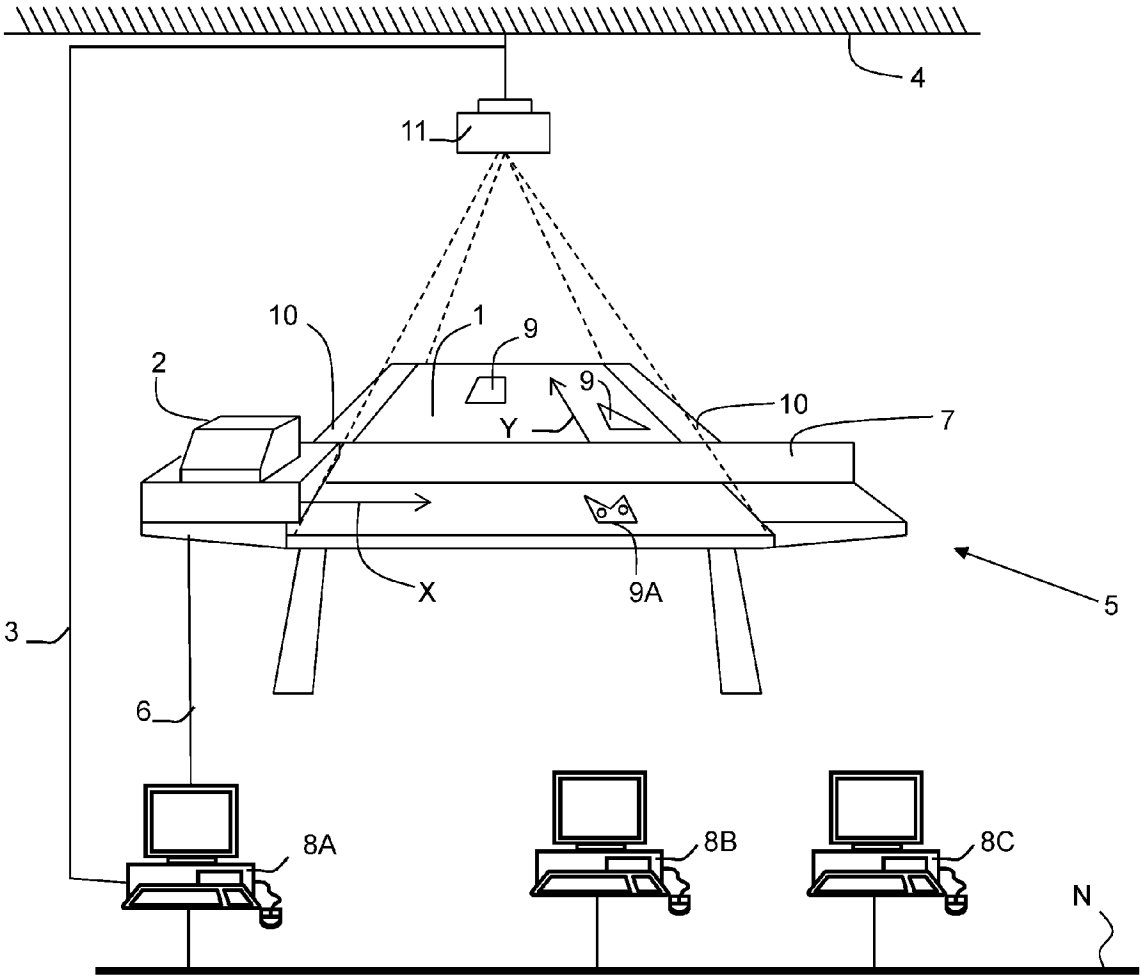
FIG. 3 shows another print system configured to apply the invented method.

FIG. 3 shows another embodiment of the flatbed printer according to the invention. The flatbed printer resembles the flatbed printer of FIG. 1, but the print system 5 of FIG. 3 also comprises a projector system 11 which is connected via a wired or wireless (not shown) network connection 3 with the print controller 8A. The projector system comprises at least one projector. The projector system 11 is, for example, attached to the ceiling 4 of a room in which the print system 5 resides. Other bodies for attaching the projector system 11 like a framework or a pole may be envisaged. The projector system 11 may also be attached to the print head or to the gantry. The reach of the at least one projector of the projector system 11 is at least the whole flatbed surface 1, as indicated by dashed lines in FIG. 3 drawn from the projector system 11 to the corners of the flatbed surface 1. The reach of the at least one projector of the projector system 11 may be extended to the guiding parts 10. The projector system 11 is calibrated with respect to a focal length, an optical centre, a pixel ratio and radial and tangential distortions. The projector system 11 may be for example set to 720 Pixels. A projected line thickness may be for example at least 2 mm.

According to an embodiment of the invention at least one digital image is projected on the flatbed surface by means of the projector system 11. The at least one digital image may comprise the plurality of strips in distinguishable different colors. The at least one digital image may comprise the boundaries of each strip in a different color. The positions of the strips on the flatbed surface 1 are stored in memory of the control unit of the printing system 5 or derived from the at least one image stored in the control unit. These positions are taken into account when moving the print head from one strip to another strip.

Figure 4:
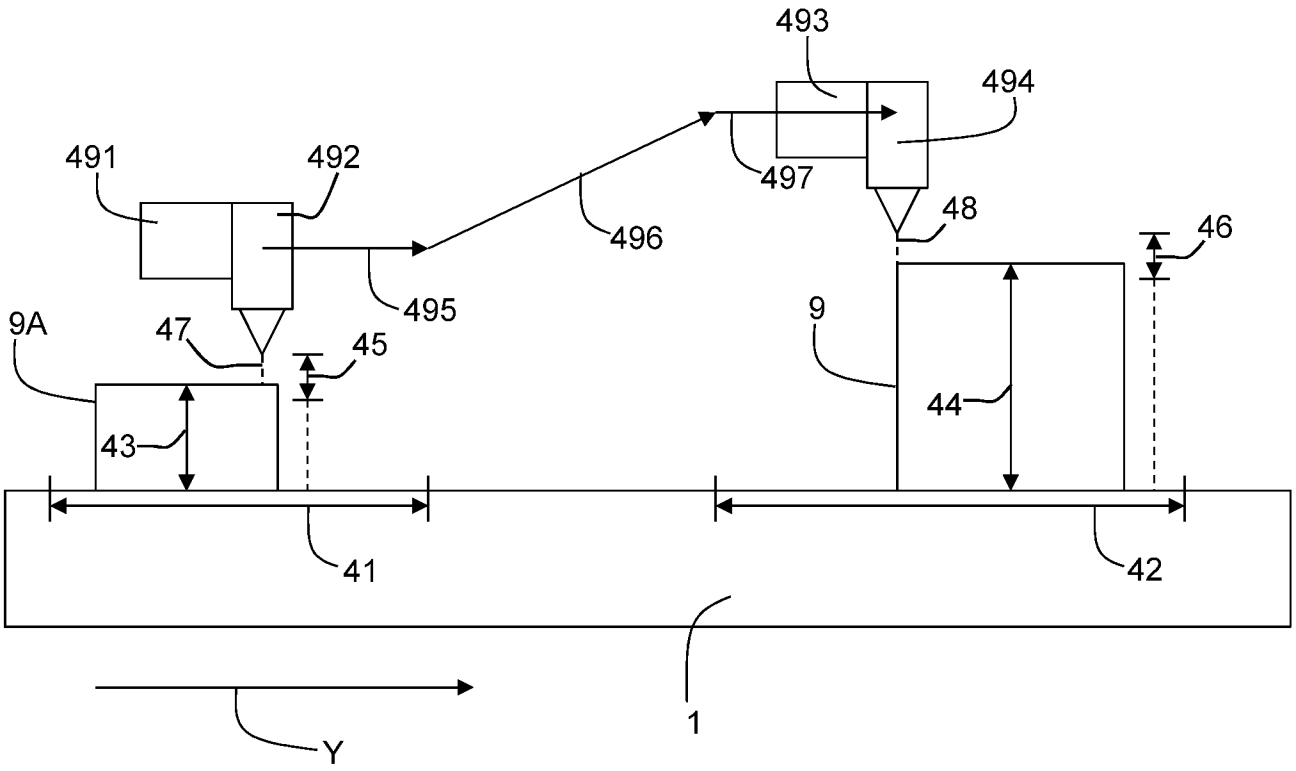
FIGS. 4-5 are side views of the flatbed surface of the printing system according to the invention.

FIG. 4 shows a side view of the flatbed surface 1.

The first strip 21 of FIG. 2 has a width 41. The piece of media 9A is lying in the first strip and has a thickness of 10 mm indicated by arrow 43. A thickness range 45 from 9 mm to 12 mm is coupled to the first strip. The tolerance distance from the print head to the flatbed surface is 3 mm, but other tolerance distances may be envisioned depending on the specifications imposed by the print system 5.

The second strip 22 of FIG. 2 has a width 42. One of the pieces of media 9 is lying in the second strip and has a thickness of 20 mm indicated by arrow 44. A thickness range 46 from 19 mm to 22 mm is coupled to the second strip.

Hereinafter the first strip 21 will also be referred to as a first strip 41 and the second strip 22 will also be referred to as the second strip 42.

The gantry on which the print head is attached is moving in the second direction Y. At a first moment in time the gantry is at a first gantry position 491 and the print head at a first print head position 492. The print head is ejecting recording material drops 47 on the piece of media 9A. When moving the gantry in the Y direction along the course 495 the print head stays at the same height above the flatbed surface 1 as long as the print head is over the first strip. When reaches the end of the first strip 41 the gantry is going to move in a lifting direction 496 which is a combination of the second direction Y and a vertical direction perpendicular to the flatbed surface 1. The gantry is moving along the course 496 until a second moment in time. At the second moment in time the print head reaches the second strip with the width 42 at a position 494. At the second moment in time the gantry has reached a position 493. At the second moment in time the print head has reached a height above the flatbed surface 1 which height is in line with thicknesses of the printing media pieces 9 which are placed in the second strip. From the second moment in time the gantry travels along a course 497 at a constant height over the flatbed surface as long as the print head is above the second strip 42.

Figure 5:
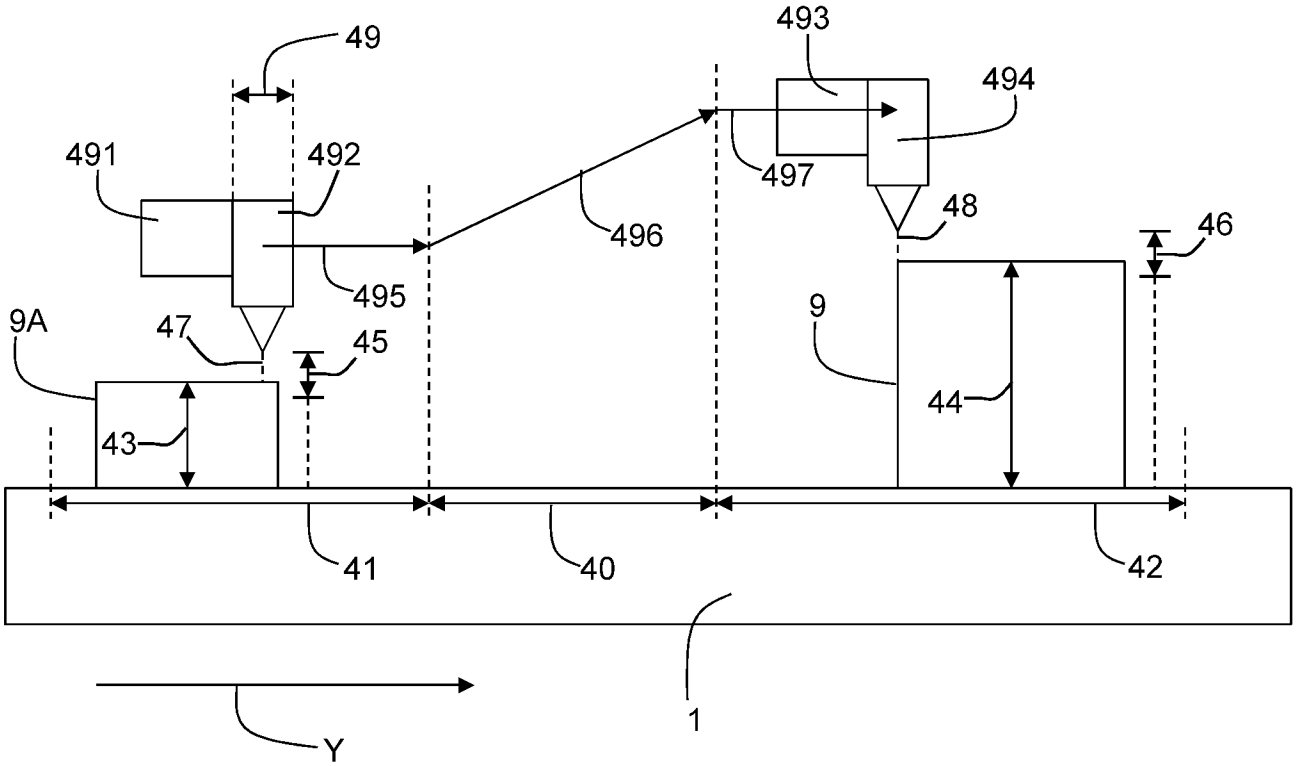

FIG. 5 shows the same side view of the flatbed surface 1 as in FIG. 4. According to an embodiment of the invention a no-place area having a width 40 is created between the two adjacent strips 41, 42. The no-place area has width 40 in the second direction Y and extends in the first direction X. It is not allowed to place a piece of media in the no-place area which is higher than 10 mm. In this way the print head touching a piece of media is avoided while the print head is moving from a first height coupled to the first strip 14 to a second height coupled to the second strip 42. The width 40 of the no-place strip depends on the angle of the direction 496, i.e. the velocity with which the gantry moves in the Y direction and the velocity with which the print head moves in the direction perpendicular to the flatbed surface 1. Furthermore the width 40 of the no-place strip depends on the geometry of the gantry and the print head. In practice, the no-place area has a minimum width derived from the geometry—width, length and height—of the gantry and the print head, in particular the geometry in the second direction Y. When selecting the minimum width for the no-place area the movement of the print head in the second direction Y will be stopped and a movement of the print head in a direction perpendicular to the flatbed surface will be started to position the print head at the correct height distance to the flatbed surface 1.

Figure 6:
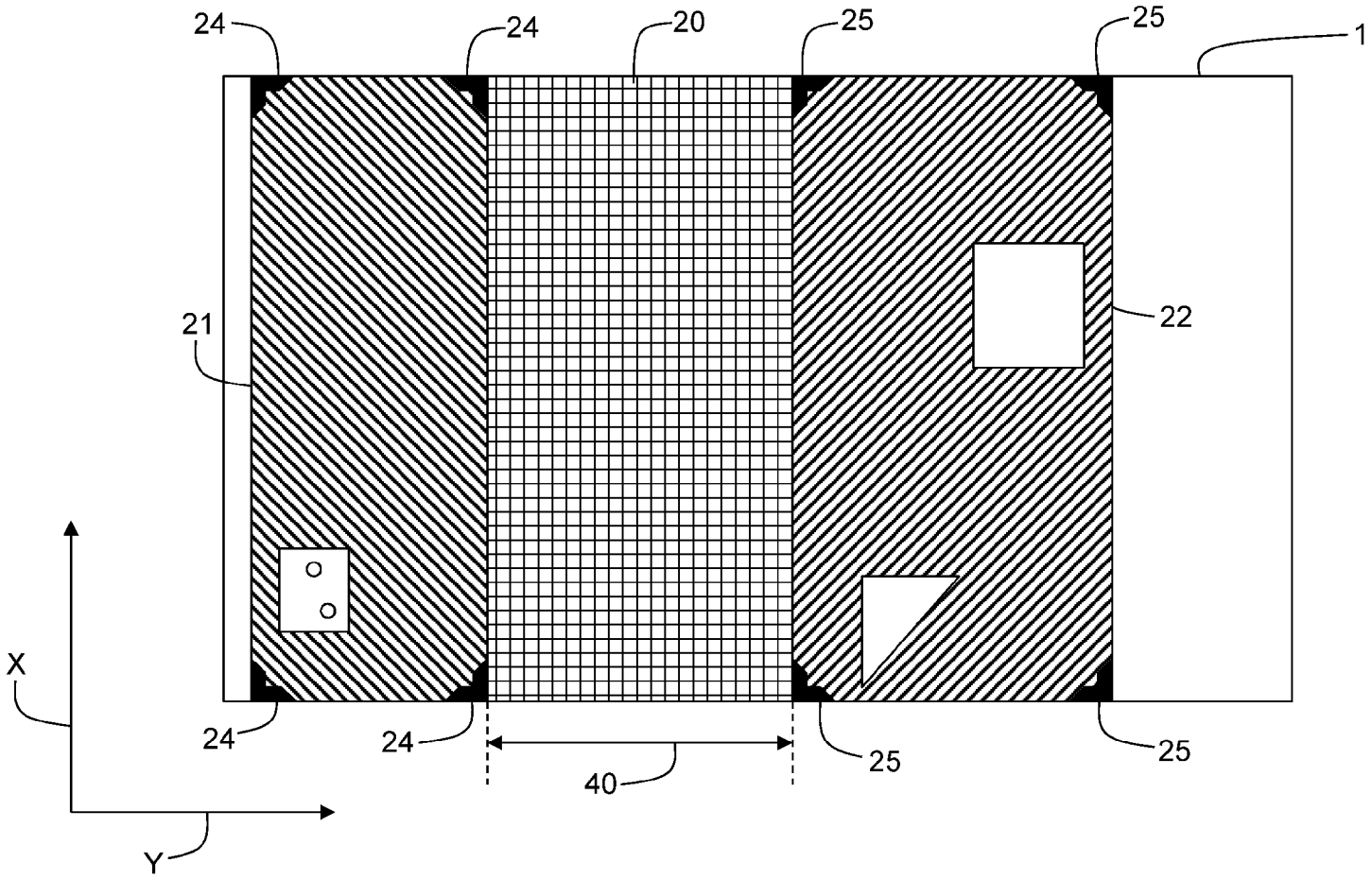
FIG. 6 is a top view of the flatbed surface of the printing system according to the invention, the flatbed surface comprising a no-place area.

Furthermore the width 40 depends on a necessary height of the print head above the first strip 41 and a necessary height of the print head above the second strip 42. Therefore a minimum width of the no-place area between the first strip 41 and the second strip 42 has to be taken into account when performing the step of dividing the flatbed surface 1 into strips. FIG. 6 shows in a top view the no-place strip 20 between the first strip 21 and the second strip 22. The no-place strip 20 has a width 40. Markers projected on the corners of the no-place strip 20 or painted on the flatbed surface 1 are envisioned (not shown). The no-place strip 20 may be projected on the flatbed surface 1 with colors that express a warning for the operator to not place pieces of media having a forbidden thickness in this no-place strip 20. An operator may even consider not to place any piece of media in this no-place strip 20 whatever its thickness is.

For convenience reasons two strips 21, 22 (41, 42) are shown in FIGS. 2, 4, 5 and 6, but dividing the flatbed surface in more than two strips may be envisioned. In that case no-place areas may be envisioned between each pair of adjacent strips.

In an embodiment the flatbed printer 5 comprises a registration system (not shown) for registering a thickness of each piece of media placed on the flatbed surface 1. The registration system is configured to check if the thickness of each piece of media placed in a strip of the plurality of strips is in accordance with the thickness range coupled to the strip. Such a registration system may a camera, a captor or a sensor. The registration system may be integrated into the projector system 11 above the flatbed surface.

Figure 7:
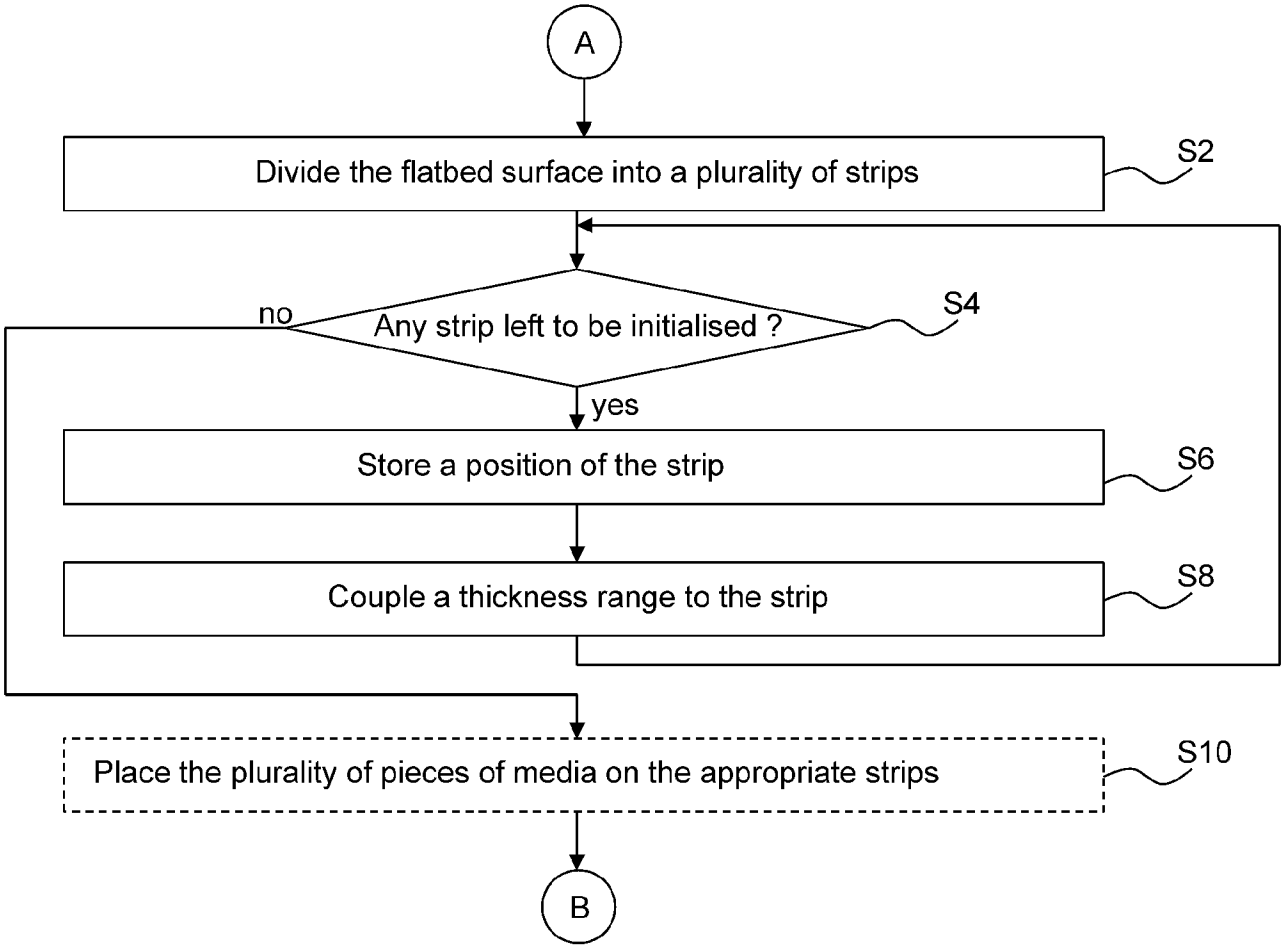
FIG. 7-10 are schematic diagrams of an embodiment of the method according to the invention.

FIG. 7 shows a flow diagram of a first embodiment of the method according to the invention. Starting point of the method is point A. Point A leads to a first step S2. In the first step S2 the flatbed surface is divided into a plurality of strips extending in the second direction over a length of the flatbed surface in the second direction. The division may take place by marking strips on the flatbed surface with markers or painting colored strip or boundaries of strip on the flatbed surface.

Steps S4-S8 comprise an initialization of the strips.

In a step S4 it is checked if there is any strip left to be initialized. If so, the method proceeds to a step S6. If not so, the method proceeds to a step S10.

In the step S6 a position of the strip is stored in storage of the control unit of the flatbed printer.

In a step S8 a thickness range in coupled in storage to the strip. The thickness range comprises a maximum allowed thickness for a piece of media to be placed in the strip on the flatbed surface and a minimum allowed thickness for a piece of media to be printed upon when placed in the strip on the flatbed surface. The method returns to the step S4.

In a step S10 the operator is placing the plurality of pieces of media on the appropriate strips. This step S10 is visualized by a dashed rectangle to indicate that this step S10 is done by the operator manually. The method proceeds to intermediate point B.

Figure 8:
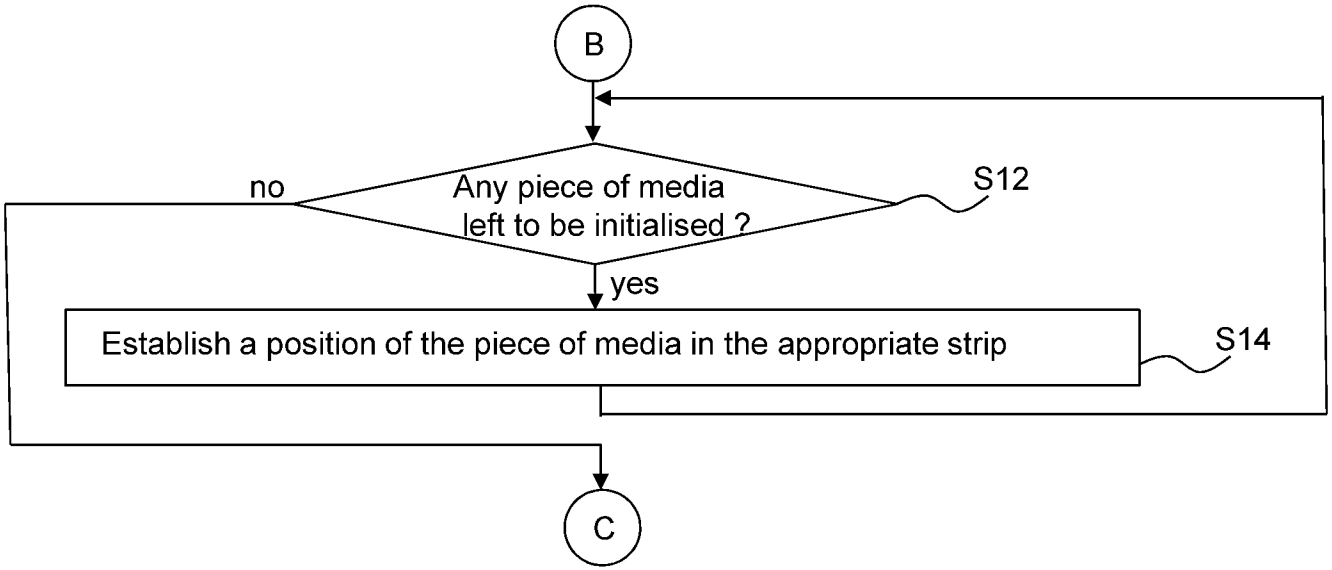

The method is further elucidated in FIG. 8. From the intermediate point B the method proceeds with a step S12.

Steps S12-S14 comprise an initialization of pieces of media in the strips.

In step S12 it is checked if there is any piece of media left to be initialized. If so, the method proceeds with a step S14. If not so, the method proceeds to intermediate point C.

In the step S14 a position of each piece of media of the plurality of pieces of media is established in the appropriate strip according to the thickness of the piece of media. The step S14 is executed after the operator has placed the pieces of media on the strips on the flatbed surface. The step S14 may be automatically executed by a registration means for registering the placement of pieces of media on the flatbed surface. Alternatively, the step S14 may be executed by entering a confirmation into the local user interface of the flatbed printer or by means of a computer device coupled to the flatbed printer a shown in FIG. 1. The method returns to step S12

Figure 9:
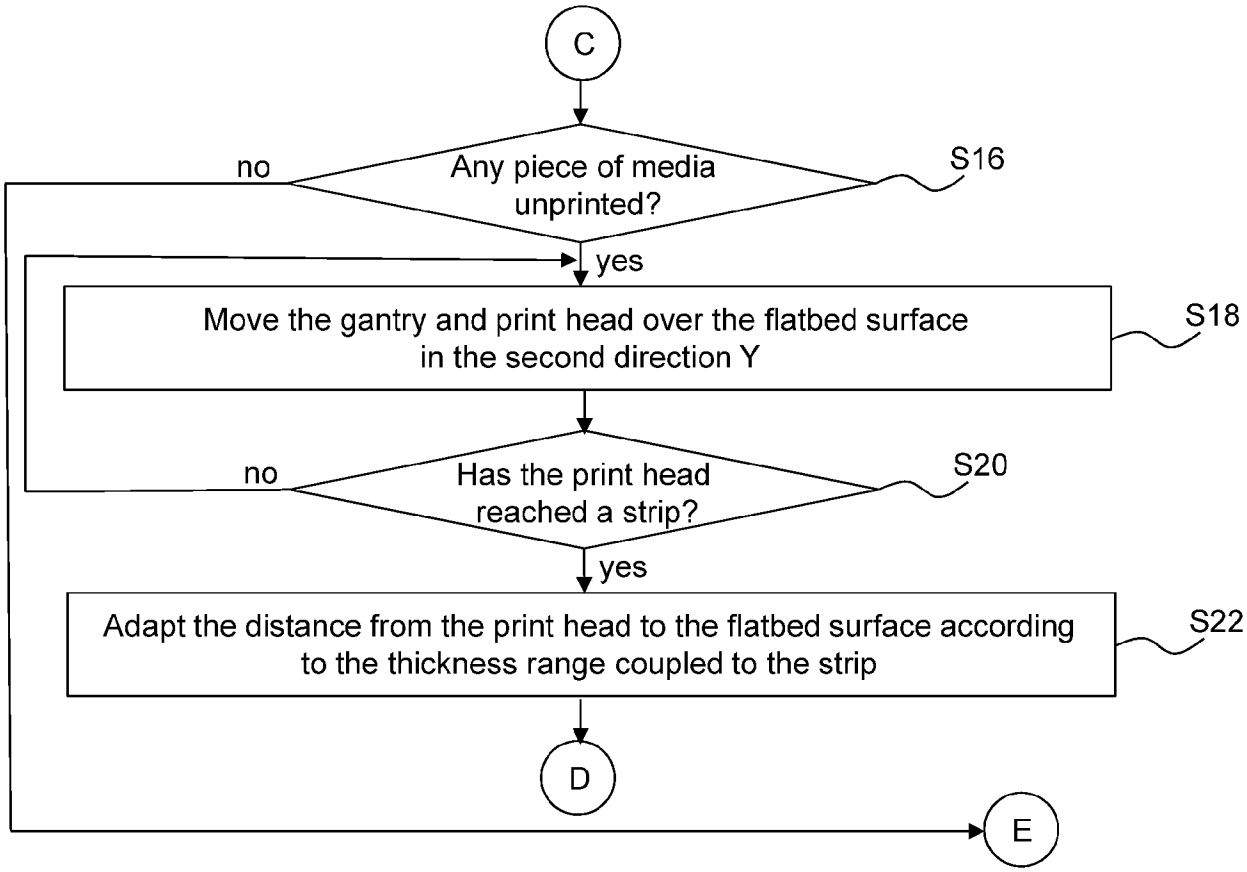

The method is further elucidated in FIG. 9. From the intermediate point C the method proceeds to a step S16.

In step S16 it is checked if there is left any piece of media unprinted on the flatbed surface. An unprinted piece of media is meant to be a piece of media on which no recording material has been ejected so far. If recording material has been ejected on the piece of media in a certain moment, the piece of media is defined as a printed piece of media from that certain moment. The check if there is any piece of media left unprinted is possible, since the control unit has knowledge about the position and thickness of the pieces of media placed on the flatbed surface. If so, the method proceeds with a step S18. If not so, the method ends in end point E.

In the step S18 the gantry and print head is moved over the flatbed surface in the second direction Y controlled by the control unit of the flatbed printer in order to print upon the unprinted pieces of media placed on the flatbed surface.

In a step S20 it is checked if the print head reaches a strip while moving over the flatbed surface in the second direction Y.

If not so, the method returns to step S18.

If so, the method proceeds to a step S22. In the step S22 the distance from the print head to the flatbed surface is adapted according to the thickness range coupled to the strip. Also a prescribed distance from the print head to the piece of media is taken into account. The method proceeds to intermediate point D.

Figure 10:
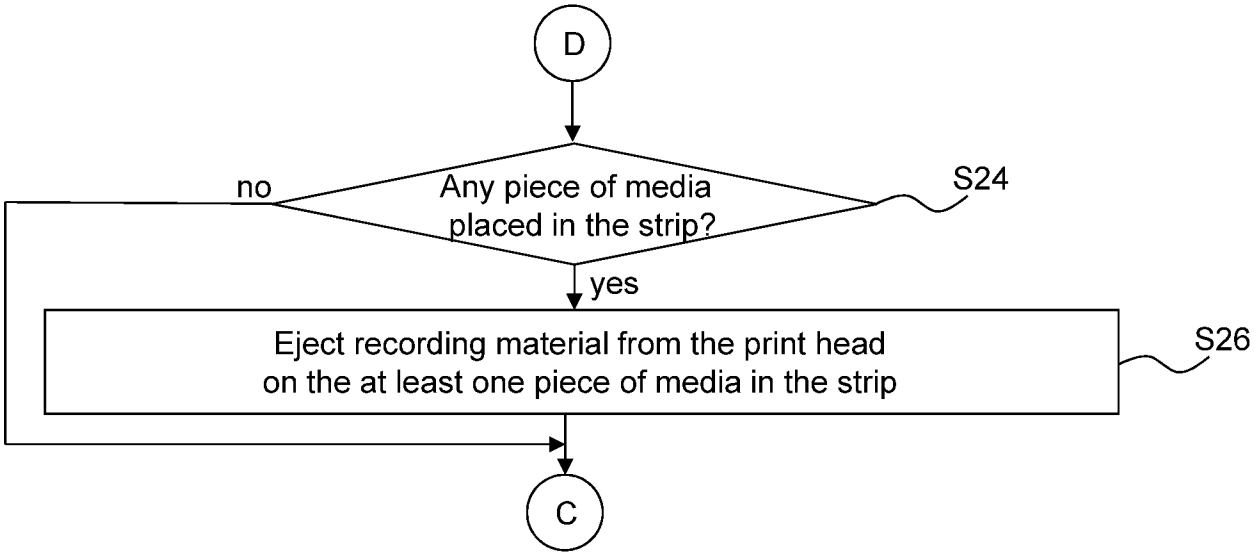

The method is further elucidated in FIG. 10. From the intermediate point D the method proceeds to a step S24.

In the step S24 it is checked whether or not there are pieces of media placed in the strip.

If not so, the method returns to intermediate point C in FIG. 9.

If so, in a step S26 recording material is ejected from the print head on the plurality of pieces of media in the strip when moving the print head over the flatbed surface in the second direction Y and when necessary and possible, in combination with the first direction X. Since the control unit has knowledge about the position and thickness of the pieces of media placed on the flatbed surface, the movements of the gantry in the second direction Y, the movements of the print head in the second direction and when necessary and possible in combination with the first direction X and the ejection of recording material is determined before the print head is going to move. During printing the print head is not moved in the direction perpendicular to the flatbed surface. The method returns to the intermediate point C in FIG. 9.

Figure 11:
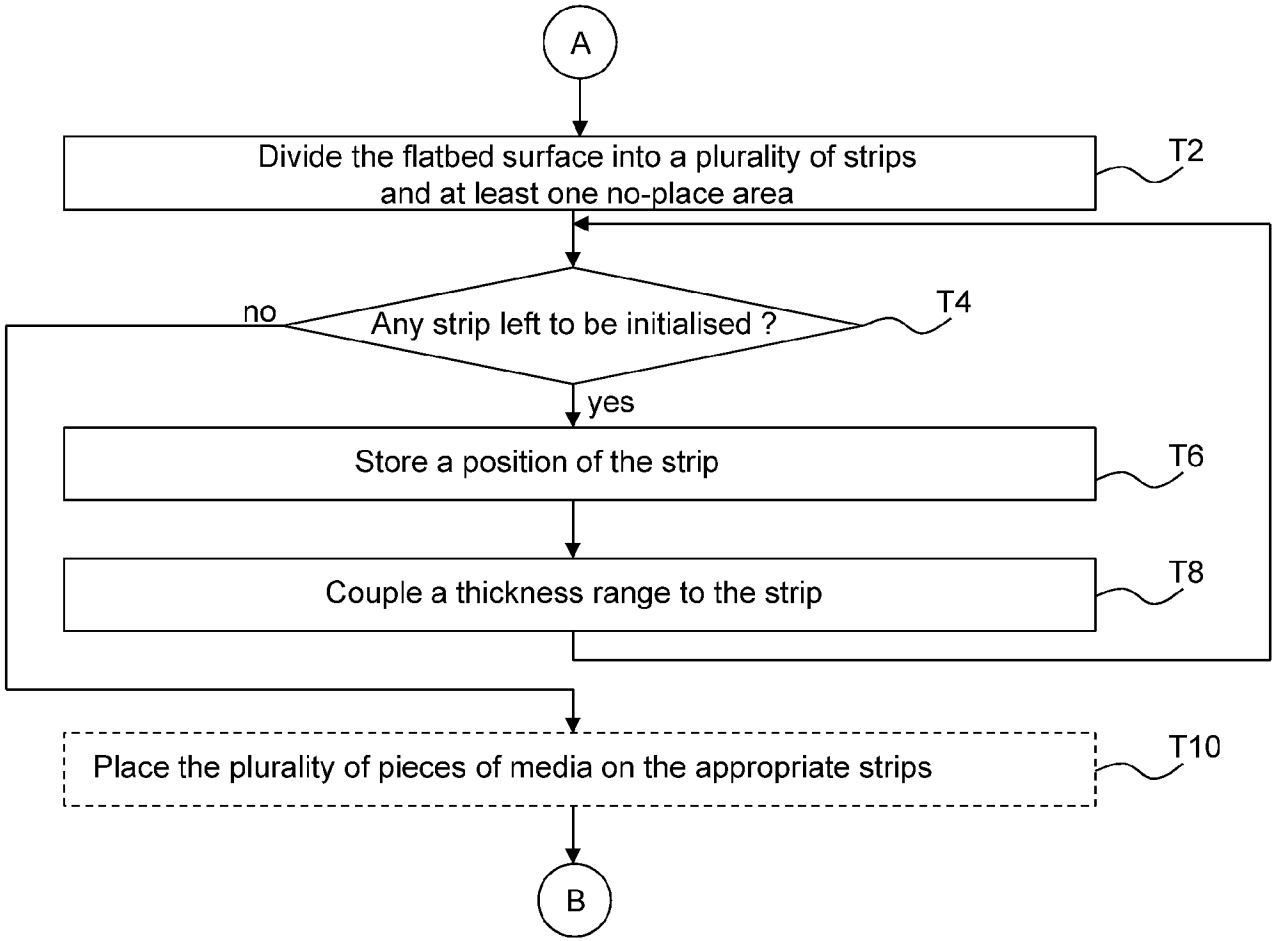
FIG. 11-15 are schematic diagrams of another embodiment of the method according to the invention.

FIG. 11 shows a flow diagram of a second embodiment of the method according to the invention. Starting point of the method is point A. Point A leads to a first step T2. In the first step T2 the flatbed surface is divided into a plurality of strips and at least one no-place area. Each strip and each no-place area is extending in the second direction over a length of the flatbed surface in the second direction. The division may take place by marking a strip and a no-place area on the flatbed surface with markers or painting a strip and a no-place area or boundaries of a strip and a no-place area on the flatbed surface.

Steps T4-T8 comprise an initialization of the strips.

In a step T4 it is checked if there is any strip left to be initialized. If so, the method proceeds to a step T6. If not so, the method proceeds to a step T10.

In the step T6 a position of the strip is stored in storage of the control unit of the flatbed printer.

In a step T8 a thickness range in coupled in storage to the strip. The thickness range comprises a maximum allowed thickness for a piece of media to be placed in the strip on the flatbed surface and a minimum allowed thickness for a piece of media to be printed upon when placed in the strip on the flatbed surface. The method returns to the step T4.

In a step T10 the operator is placing the plurality of pieces of media on the appropriate strips. This step T10 is visualized by a dashed rectangle in FIG. 11 to indicate that this step T10 is done by the operator manually. The method proceeds to intermediate point B.

Figure 12:
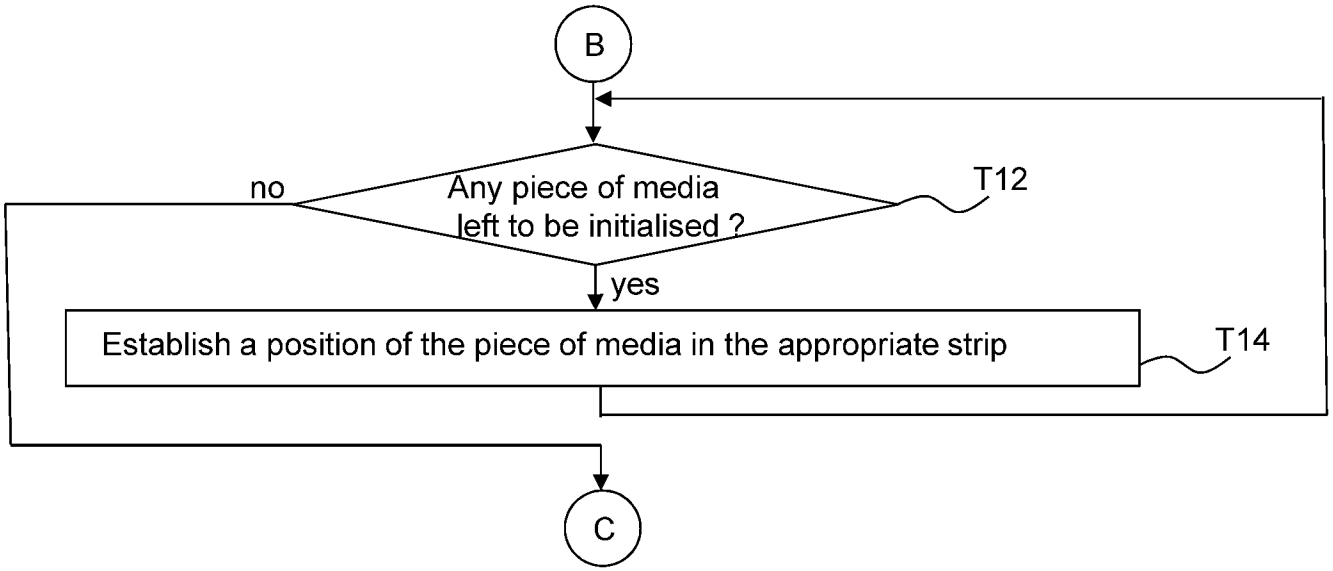

The method is further elucidated in FIG. 12. From the intermediate point B the method proceeds with a step T12.

Steps T12-T14 comprise an initialization of pieces of media in the strips.

In step T12 it is checked if there is any piece of media left to be initialized. If so, the method proceeds with a step T14. If not so, the method proceeds to intermediate point C.

In the step T14 a position of each piece of media of the plurality of pieces of media is established in the appropriate strip according to the thickness of the piece of media. The step T14 is executed after the operator has placed the pieces of media on the strips on the flatbed surface. The step T14 may be automatically executed by a registration means for registering the placement of pieces of media on the flatbed surface. Alternatively, the step T14 may be executed by entering a confirmation into the local user interface of the flatbed printer or by means of a computer device coupled to the flatbed printer a shown in FIG. 1. The method returns to step T12.

Figure 13:
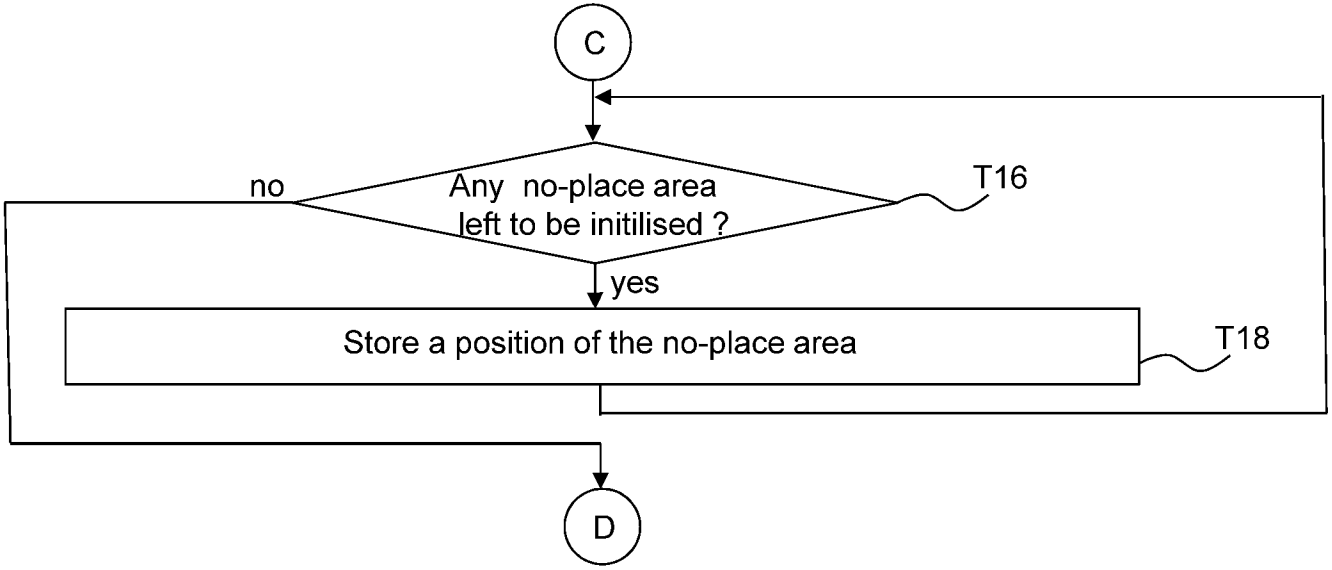

The method is further elucidated in FIG. 13. From the intermediate point C the method proceeds with a step T16.

Steps T16-T18 comprise an initialization of no-place areas.

In step T16 it is checked if there is any no-place area left to be initialized. If so, the method proceeds with a step T18. If not so, the method proceeds to intermediate point D.

In the step T18 a position of each no-place area is stored in storage of the control unit of the flatbed printer. The method returns to step T16. The steps T16 and T18 may be executed before the steps T12 and T14, or even directly after step T2.

Figure 14:
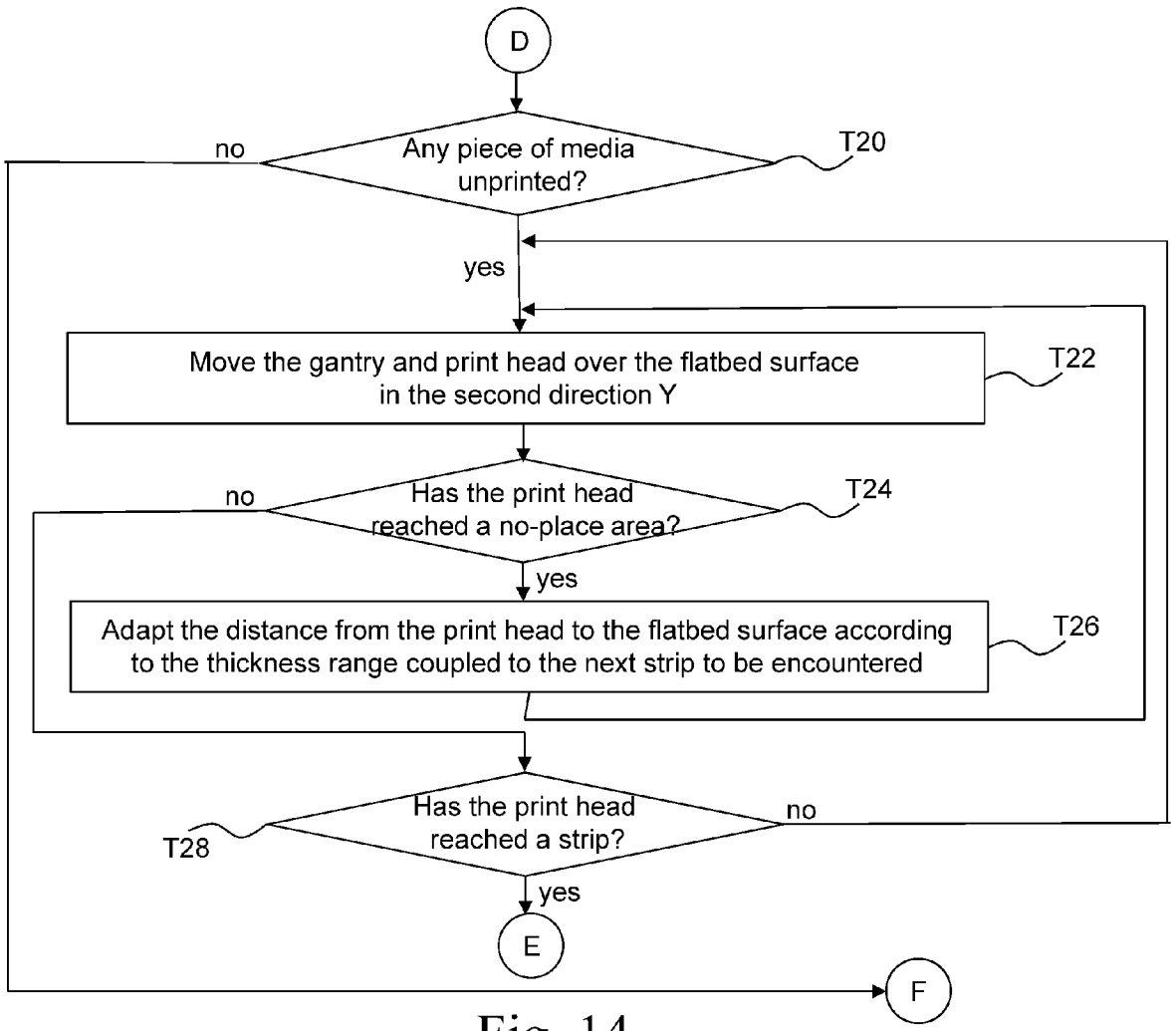

The method is further elucidated in FIG. 14. From the intermediate point D the method proceeds to a step T20.

In step T20 it is checked if there is left any piece of media unprinted on the flatbed surface. This check is possible, since the control unit has knowledge about the position and thickness of the pieces of media placed on the flatbed surface. If so, the method proceeds with a step T22. If not so, the method ends in end point F.

In the step T22 the gantry and print head is moved over the flatbed surface in the second direction Y controlled by the control unit of the flatbed printer in order to print upon the unprinted pieces of media placed on the flatbed surface.

In a step T24 it is checked if the print head reaches a no-place area while moving over the flatbed surface in the second direction Y.

If not so, the method proceeds to a step T28.

If so, the method proceeds to a step T26. In the step T26 the distance from the print head to the flatbed surface is adapted according to the thickness range coupled to the next strip to be reached after leaving the no-place area. Also a prescribed distance from the print head to the piece of media is taken into account. The method returns to the step T22.

In a step T28 it is checked if the print head reaches a strip while moving over the flatbed surface in the second direction Y.

If not so, the method returns to step T22.

If so, the method proceeds to an intermediate point E.

Figure 15:
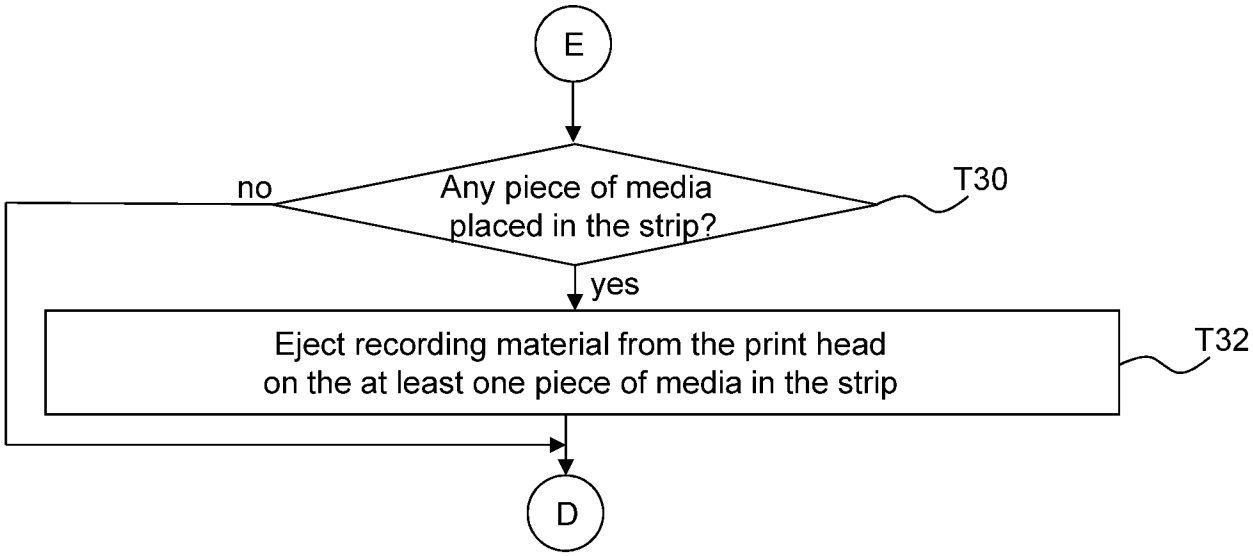

The method is further elucidated in FIG. 15. From the intermediate point E the method proceeds to a step T30.

In the step T30 it is checked whether or not there are pieces of media placed in the strip.

If not so, the method returns to intermediate point D in FIG. 14.

If so, in a step T32 recording material is ejected from the print head on the plurality of pieces of media in the strip when moving the print head over the flatbed surface in the second direction Y and when necessary and possible, in combination with the first direction X. Since the control unit has knowledge about the position and thickness of the pieces of media placed on the flatbed surface, the movements of the gantry in the second direction Y, the movements of the print head in the second direction and when necessary and possible in combination with the first direction X and the ejection of recording material is determined before the print head is going to move. During printing the print head is not moved in the direction perpendicular to the flatbed surface. The method returns to the intermediate point D in FIG. 14.

The above disclosure is intended as merely exemplary, and not to limit the scope of the invention, which is to be determined by reference to the following claims.

The invention claimed is:

1. A method for printing by means of a flatbed printer comprising a flatbed surface for placing a plurality of pieces of media to be printed upon, the plurality of pieces of media having different thicknesses, a control unit for controlling the printing of digital images on the plurality of pieces of media, a gantry constructed to move over the flatbed surface in a first direction and extending in a second direction, a print head configured to eject recording material on the plurality of pieces of media and attached to the gantry, the method comprising the steps of a) dividing the flatbed surface into a plurality of strips extending in the second direction over a length of the flatbed surface in the second direction, b) storing a position of each of the plurality of strips in storage of the control unit, c) for each strip coupling in storage a thickness range to the strip, the thickness range comprising a maximum allowed thickness for a piece of media to be placed in the strip on the flatbed surface and a minimum allowed thickness for a piece of media to be printed upon when placed in the strip on the flatbed surface, d) establishing a position of each piece of media of the plurality of pieces of media in the appropriate strip according to the thickness of the piece of media, e) moving the print head over the flatbed surface, f) ejecting the recording material on the plurality of pieces of media when moving the print head over the flatbed surface, wherein upon the print head reaching a strip when moving over the flatbed surface, adapting the distance from the print head to the flatbed surface according to the thickness range coupled to the strip.

2. The method according to claim 1, wherein the flatbed printer comprises a projector system connected to the control unit and positioned above the flatbed surface and the dividing step comprises the step of projecting at least one image on the flatbed surface, the at least one image displaying the plurality of strips.

3. The method according to claim 2, wherein the at least one image comprises a textual indication which indicates which thicknesses of pieces of media are allowed in each strip.

4. The method according to claim 2, wherein the at least one image comprises a color which indicates which thicknesses of pieces of media are allowed in each strip.

5. The method according to claim 1, wherein the dividing step comprises the step of detecting marks placed on the flatbed surface, which marks are marking the strips.

6. The method according to claim 1, wherein the flatbed printer comprises a registration system for registering a thickness of each piece of media placed on the flatbed surface and the establishing step comprises a step of checking by means of the registration system if the thickness of each piece of media placed in a strip of the plurality of strips is in accordance with the thickness range coupled to the strip.

7. The method according to claim 1, wherein the method comprises the steps of creating a no-place area on the flatbed surface between two adjacent strips of the plurality of strips, in which no-place area no piece of media is allowed to be placed that has a thickness larger than the minimum of the thickness ranges coupled to the two adjacent strips, and adapting the distance from the print head to the flatbed surface in accordance with the thickness range coupled to one strip of the two adjacent strips while the print head is moving in the no-place area from the other strip of the two adjacent strips to the one strip.

8. The method according to claim 1, wherein the flatbed printer is capable to print relief prints and the step of coupling the thickness range to a strip takes into account a total height of a plurality of ink layers to be ejected on the piece of media.

9. A flatbed printer comprising a flatbed surface for placing a plurality of pieces of media to be printed upon, the plurality of pieces of media having different thicknesses, a control unit for controlling the printing of digital images on the plurality of pieces of media, a gantry constructed to move over the flatbed surface in a first direction and extending in a second direction, a print head configured to eject recording material on the plurality of pieces of media and attached to the gantry, wherein the flatbed surface is divided into a plurality of strips extending in the second direction over a length of the flatbed surface in the second direction, the control unit comprises in storage for each strip of the plurality of strips a position of the strip on the flat bed surface and a thickness range coupled to the strip, the thickness range comprises a maximum allowed thickness for a piece of media to be placed in the strip on the flatbed surface and a minimum allowed thickness for a piece of media to be printed upon when placed in the strip on the flatbed surface, the control unit comprises establishing means for establishing a position of each piece of media of the plurality of pieces of media in the appropriate strip according to the thickness of the piece of media, and the flatbed printer comprises adapting means for adapting the distance from the print head to the flatbed surface, wherein upon the print head reaching a strip when moving over the flatbed surface in order to eject the recording material on the plurality of pieces of media, the adapting means adapt the distance from the print head to the flatbed surface according to the thickness range coupled to the strip.

10. The flatbed printer according to claim 9, wherein the flatbed printer comprises a projector system connected to the control unit and positioned above the flatbed surface for projecting at least one image on the flatbed surface, the at least one image displaying the plurality of strips.

11. The flatbed printer according to claim 10, wherein the at least one image comprises a textual indication which indicates which thicknesses of pieces of media are allowed in each strip.

12. The flatbed printer according to claim 10, wherein the at least one image comprises a color which indicates which thicknesses of pieces of media are allowed in each strip.

13. The flatbed printer according to claim 9, wherein the flatbed printer comprises a registering system for registering a thickness of each piece of media placed on the flatbed surface and the control unit is configured to check by means of the registration system if the thickness of each piece of media placed in a strip of the plurality of strips is in accordance with the thickness range coupled to the strip.

14. The flatbed printer according to claim 9 wherein the flatbed surface comprises a no-place area between two adjacent strips of the plurality of strips, in which no-place area no piece of media is allowed to be placed that has a thickness larger than the minimum of the thickness ranges coupled to the two adjacent strips, and the control unit is configured to adapt the distance from the print head to the flatbed surface by means of the adapting means in accordance with the thickness range coupled to one strip of the two adjacent strips upon moving the print head in the no-place area from the other strip of the two adjacent strips to the one strip.

15. A non-transitory recording medium comprising computer executable program code configured to instruct a computer to perform the method according to claim 1.

16. The method according to claim 1, wherein the flatbed printer comprises a registration system for registering a thickness of each piece of media placed on the flatbed surface and the establishing step comprises a step of checking by means of the registration system if the thickness of each piece of media placed in a strip of the plurality of strips is in accordance with the thickness range coupled to the strip, wherein the flatbed printer comprises a projector system connected to the control unit and positioned above the flatbed surface and the dividing step comprises the step of projecting at least one image on the flatbed surface, the at least one image displaying the plurality of strips, and the step of detecting marks placed on the flatbed surface, which marks are marking the strips, wherein the method comprises the steps of creating a no-place area on the flatbed surface between two adjacent strips of the plurality of strips, in which no-place area no piece of media is allowed to be placed that has a thickness larger than the minimum of the thickness ranges coupled to the two adjacent strips, and adapting the distance from the print head to the flatbed surface in accordance with the thickness range coupled to one strip of the two adjacent strips while the print head is moving in the no-place area from the other strip of the two adjacent strips to the one strip; and wherein the flatbed printer is capable to print relief prints and the step of coupling the thickness range to a strip takes into account a total height of a plurality of ink layers to be ejected on the piece of media.

17. The flatbed printer according to claim 9, wherein the flatbed printer comprises a registering system for registering a thickness of each piece of media placed on the flatbed surface and the control unit is configured to check by means of the registration system if the thickness of each piece of media placed in a strip of the plurality of strips is in accordance with the thickness range coupled to the strip, wherein the flatbed surface comprises a no-place area between two adjacent strips of the plurality of strips, in which no-place area no piece of media is allowed to be placed that has a thickness larger than the minimum of the thickness ranges coupled to the two adjacent strips, and the control unit is configured to adapt the distance from the print head to the flatbed surface by means of the adapting means in accordance with the thickness range coupled to one strip of the two adjacent strips upon moving the print head in the no-place area from the other strip of the two adjacent strips to the one strip, and wherein the flatbed printer comprises a projector system connected to the control unit and positioned above the flatbed surface for projecting at least one image on the flatbed surface, the at least one image displaying the plurality of strips.

* * * * *